US009506305B2

(12) United States Patent
Leuchtenberg et al.

(10) Patent No.: US 9,506,305 B2
(45) Date of Patent: Nov. 29, 2016

(54) DRILLING METHOD FOR DRILLING A SUBTERRANEAN BOREHOLE

(71) Applicant: MANAGED PRESSURE OPERATIONS PTE. LTD., Singapore (SG)

(72) Inventors: Christian Leuchtenberg, Singapore (SG); Pat Savage, Diamond Valley (AU)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 0 days.

(21) Appl. No.: 14/431,917

(22) PCT Filed: Sep. 27, 2013

(86) PCT No.: PCT/GB2013/052526
§ 371 (c)(1),
(2) Date: Mar. 27, 2015

(87) PCT Pub. No.: WO2014/049369
PCT Pub. Date: Apr. 3, 2014

(65) Prior Publication Data

US 2015/0252637 A1 Sep. 10, 2015

(30) Foreign Application Priority Data

Sep. 28, 2012 (GB) ..... 1217362.1

(51) Int. Cl.
*E21B 7/12* (2006.01)
*E21B 21/08* (2006.01)
*E21B 21/00* (2006.01)

(52) U.S. Cl.
CPC ..... *E21B 21/001* (2013.01); *E21B 21/08* (2013.01)

(58) Field of Classification Search
CPC ..... E21B 7/12; E21B 21/001; E21B 21/08
(Continued)

(56) References Cited

U.S. PATENT DOCUMENTS 2,158,356 A 5/1939 Dyer
4,224,989 A 9/1980 Blount
(Continued)

FOREIGN PATENT DOCUMENTS

AU 2011244852 A1 12/2011
FR 2787827 A1 6/2000
(Continued)

OTHER PUBLICATIONS

Fossil et al., "Managed Pressure Drilling for Subsea Applications; Well Control Challenges in Deep Waters", SPE/IADC 91633, XP055123744, DOI: http://dx.doi.org/10.2118/91633-MS, URL:https://www.onepetro.org/conference-paper/SPE-91633-MS, 2004, pp. 1-10.
(Continued)

*Primary Examiner* — Matthew R Buck
(74) *Attorney, Agent, or Firm* — Norman B. Thot

(57) ABSTRACT

A method of drilling a subterranean wellbore using a drill string including the steps of estimating or determining a reduced static density of a drilling fluid based on the equivalent circulating density of the drilling fluid in a section of the wellbore, providing a drilling fluid having substantially that reduced static density, introducing the drilling fluid having said reduced static density into the wellbore, and removing the drilling fluid from the wellbore via a return line.

17 Claims, 3 Drawing Sheets

(58) Field of Classification Search
USPC ..... 175/5, 40, 48, 65, 206, 207; 166/358
See application file for complete search history.

(56) References Cited

U.S. PATENT DOCUMENTS

| | | | | |
|---|---|---|---|---|
| 6,129,152 | A | 10/2000 | Hosie et al. | |
| 6,220,087 | B1 | 4/2001 | Hache et al. | |
| 6,374,925 | B1 * | 4/2002 | Elkins | E21B 21/08 175/25 |
| 6,394,195 | B1 * | 5/2002 | Schubert | E21B 21/08 166/359 |
| 6,415,877 | B1 | 7/2002 | Fincher et al. | |
| 6,527,062 | B2 * | 3/2003 | Elkins | E21B 21/08 175/25 |
| 6,561,774 | B2 | 5/2003 | Layman | |
| 6,854,532 | B2 | 2/2005 | Fincher et al. | |
| 7,278,496 | B2 * | 10/2007 | Leuchtenberg | E21B 21/08 166/53 |
| 7,497,266 | B2 * | 3/2009 | Fossli | E21B 21/001 166/358 |
| 7,699,109 | B2 | 4/2010 | May et al. | |
| 7,926,560 | B2 | 4/2011 | Bailey et al. | |
| 9,057,233 | B2 * | 6/2015 | Ree | E21B 21/001 |
| 9,068,420 | B2 * | 6/2015 | Rajabi | E21B 21/08 |
| 2002/0066569 | A1 | 6/2002 | Schubert et al. | |
| 2003/0066650 | A1 * | 4/2003 | Fontana | E21B 7/12 166/358 |
| 2008/0296062 | A1 | 12/2008 | Horton, III et al. | |
| 2009/0063055 | A1 | 3/2009 | Schneider et al. | |
| 2011/0100710 | A1 * | 5/2011 | Fossli | E21B 21/001 175/7 |
| 2011/0278014 | A1 | 11/2011 | Hughes et al. | |
| 2012/0227978 | A1 * | 9/2012 | Fossli | E21B 21/001 166/363 |
| 2013/0192841 | A1 * | 8/2013 | Feasey | E21B 21/08 166/336 |
| 2013/0233562 | A1 | 9/2013 | Leuchtenberg | |
| 2015/0122505 | A1 | 5/2015 | Judge et al. | |
| 2015/0252637 | A1 | 9/2015 | Leuchtenberg et al. | |

FOREIGN PATENT DOCUMENTS

| | | | |
|---|---|---|---|
| GB | 2469119 | A | 10/2010 |
| GB | 2500188 | A | 9/2013 |
| GB | 2501094 | A | 10/2013 |
| WO | WO 2009/123476 | A1 | 10/2009 |
| WO | WO 2012/127227 | A2 | 9/2012 |
| WO | WO 2013/055226 | A1 | 4/2013 |
| WO | WO 2013/115651 | A2 | 8/2013 |
| WO | WO 2013/184866 | A2 | 12/2013 |
| WO | WO 2014/049369 | A2 | 4/2014 |

OTHER PUBLICATIONS

C. Cole: "Double acting diaphragm pumps save space", Engineer Live, pp. 1-2 (2013).

* cited by examiner

DRILLING METHOD FOR DRILLING A SUBTERRANEAN BOREHOLE

FIELD OF THE INVENTION

The present invention relates to a method of drilling a subterranean borehole which is particularly, but not exclusively, for the purpose of extracting hydrocarbons from a subterranean oil reservoir.

DESCRIPTION OF THE PRIOR ART

The drilling of a wellbore is typically carried out using a steel pipe known as a drill string with a drill bit at the lowermost end. The entire drill string may be rotated using an over-ground drilling motor, or the drill bit may be rotated independently of the drill string using a fluid powered motor or motors mounted in the drill string just above the drill bit. As drilling progresses, a flow of mud is used to carry the debris created by the drilling process out of the wellbore. Mud is pumped through an inlet line down the drill string, to pass through/over/around the drill bit, and returns to the surface via an annular space between the outer wall of the drill string and the wellbore (generally referred to as the annulus). When drilling off-shore, a riser is provided and this comprises a larger diameter pipe which extends around the drill string, upwards from the well head. The annular space between the riser and the drill string, hereinafter referred to as the riser annulus, serves as an extension to the annulus, and provides a conduit for return of the mud to mud reservoirs. The mud may additionally be used to cool the drill bit, to lubricate the system and power a downhole motor.

Mud is a broad drilling term (known in the relevant art), and in this context it is used to describe any fluid or fluid mixture used during drilling and covers a broad spectrum from air, nitrogen, misted fluids in air or nitrogen, foamed fluids with air or nitrogen, aerated or nitrified fluids through to heavily weighted mixtures of oil or water with solid particles.

Conventionally, the well bore is open (during drilling) to atmospheric pressure with no surface applied pressure or other pressure existing in the system. The drill pipe rotates freely without any sealing elements imposed or acting on the drill pipe at the surface. In such operations there is no requirement to divert the return fluid flow or exert pressure on the system.

During drilling the drill bit penetrates through underground layers of rock and structures until the drill bit reaches one or more reservoirs, also known as formations, pore spaces or voids, which contain hydrocarbons at a given temperature and pressure contained within the rock. These hydrocarbons are contained within the pore space of the rock which may also contain water, oil, and gas constituents. Due to the forces being exerted from the layers of rock above the formations, these formation fluids are trapped within the pore space at a known or unknown pressure, referred to as pore pressure. An unplanned inflow of these formation fluids (also known as reservoir fluids) is well known in the art, and is referred to as a formation influx, or kick.

The mud is a fluid of a given density, also referred to as weight, and, most importantly, is also used to deal with any formation influx (or kick) that might occur during drilling. For example, in a type of drilling known as "overbalanced" drilling, the density of the mud is selected so that it produces a hydrostatic pressure (due to the weight of the mud) at the bottom of the wellbore (the bottom hole pressure, or BHP) which is high enough to counter balance the pressure of fluids in the formation ("the formation pore pressure"), thus substantially preventing inflow (to the wellbore) of fluids from formations penetrated by the wellbore. In other words, the mud acts as a barrier against formation fluid entering the wellbore. The BHP can be varied and controlled by exploiting the relationship between the density of the mud and the vertical extent of the mud within the wellbore, so as to increase or decrease the hydrostatic pressure applied by the mud at the bottom of the wellbore. If the BHP falls below the formation pore pressure, an influx or kick of the formation fluid may occur, i.e. gas, oil or water, can enter the wellbore. Alternatively, if the BHP is too high, it might be higher than the fracture strength of the rock in the formation. Under such circumstances, the pressure of mud at the bottom of the wellbore can fracture the formation, and mud can enter the formation. This loss of mud causes a momentary reduction in BHP which can, in turn, lead to the formation of a kick. Exceeding the formation fracture pressure can also lead to the mud being lost as it flows into the formation. Depending on the magnitude of these losses there is a significant risk that the consequent decrease in the hydrostatic pressure in the well will result in a decreased height/level of mud in the wellbore with a corresponding decrease of the BHP to below the formation pressure. This undesired condition will likely result in a formation influx. These conditions, well known in the art, are also referred to as losses (minor, major, and total/severe depending on the magnitude), or lost circulation.

Another aspect of the BHP exerted by mud is that the BHP has two values associated with it—a static BHP value and a circulating BHP value. The static BHP of the mud relates to the pressure the mud exerts when it is static, i.e. the mud is not being circulated through the drill string. The circulating BHP of the mud relates to the pressure exerted by the mud during circulation of the mud through the drill string, the annulus and through the riser to surface during drilling.

During circulation the pressure exerted by the mud is higher than when it is the static. This is because there are frictional losses over the total length of the wellbore, caused by, for example, the geometry of the drill string relative to the wellbore changing the annular clearance between them or the viscosity or density of the fluid affecting how it flows through the annulus. This reduces the flow rate of the mud. These losses occur from the bottom of the wellbore through to the point at which the mud exits to the surface above ground. Hence, an increased amount of pressure is required to circulate the mud so as to effectively move solids, clean the debris within the wellbore and power the drill bit/string while drilling. The greatest pressure is generated at the bottom of the well bore as at this point the frictional losses along the entire wellbore length have occurred. It is common to relate this increase in circulating BHP to an equivalent circulating density (ECD) mud density which is, for the reasons described, higher than the density of the static mud. Of course, both the ECD and BHP are directly affected by the basic density of the mud.

It is known to have a static mud density that includes a safety factor, i.e. increasing the density of the static mud, and to use this value for both static and circulating conditions such that the BHP is sufficient to prevent a kick occurring.

However, should the system become underbalanced, for example, due to formation influx, it is known to increase the density of the mud so as to increase the BHP of the well bore; thereby reinstating the overbalanced drilling conditions when it is circulated in the wellbore. This mud of increased density is known as kill mud and is circulated so as to fill the entire wellbore and drill string volume. Such operations that are used to reinstate overbalanced drilling conditions may be referred to as well control operations.

Conventional drilling systems aim to maintain the BHP above the pore pressure of the formation but below the fracture pressure of the formation. Managing the BHP in this way is known as Managed Pressure Drilling (MPD).

In managed pressure drilling, the annulus or riser annulus is closed using a pressure containment device such as a rotating control device, rotating blow out preventer (BOP) or riser drilling device. This device includes sealing elements which engage with the outside surface of the drill string so that flow of fluid between the sealing elements and the drill string is substantially prevented, whilst still permitting rotation of the drill string. The location of this device is not critical, and for off-shore drilling, it may be mounted in the riser at, above or below sea level, on the sea floor, or even inside the wellbore. The sealing elements are provided in a housing of the rotating control device (RCD), rotating blow out preventer (RBOP), pressure control while drilling (PCWD), or rotating control head (RCH) used for closing the riser annulus, with the sealing element being in direct contact with the drill pipe. This provides the required isolation of the riser annular from the atmosphere whilst ensuring there is sufficient integrity of the seal against the drill pipe for safe drilling. A typical sealing element in existing pressure containment designs includes an elastomer or rubber packing/sealing element and a bearing assembly that allows the sealing element to rotate along with the drill string. There is no rotational movement between the drill string and the sealing element as the bearing assembly itself permits rotational movement of the drill string during drilling. These are well known in the art and are described in U.S. Pat. Nos. 7,699,109, 7,926,560, and 6,129,152.

A flow control device, typically known as a flow spool, provides a flow path for the escape of mud from the annulus/riser annulus. After the flow spool, there is usually a pressure control manifold with at least one adjustable choke or valve to control the rate of flow of mud out of the annulus/riser annulus. When closed during drilling, the pressure containment device creates a back pressure in the wellbore, and this back pressure can be controlled by using the adjustable choke or valve on the pressure control manifold to control the degree to which flow of mud out of the annulus/riser annulus is restricted.

Managed pressure drilling and/or underbalanced drilling may use equipment that has been specifically developed to keep the well closed at all times to maintain pressures in the well head that are non-atmospheric; unlike the conventional overbalanced drilling method. Thus, managed pressure operations are closed loop systems. Managed pressure drilling also utilizes lighter static mud weights as drilling fluid, as these exert a lower pressure, thereby keeping the BHP below the fracture pressure of the formation—together with surface applied back pressure during drilling to provide the necessary equivalent hydrostatic pressure to prevent the formation influx from entering the wellbore.

Underbalanced drilling allows reservoir fluids to flow to the surface together with the mud/drilling fluid during drilling and tripping. Therefore a pressurized annulus containing hydrocarbons, solids, and drilling fluid exists below the pressure seal of the pressure containment device. Both methods result in a pressurized annulus containing drilling fluids, and/or solids, and/or formation fluids below the seal of the pressure containment device.

Running managed pressure drilling or underbalanced drilling offshore is more difficult than onshore drilling and the degree of difficulty increases when drilling deeper under the sea. This is because the riser section from the seabed floor to the drilling platform becomes an extension of the wellbore and its length is therefore greater with increasing water depth. Therefore the increased hydrostatic pressures generated in the well bore and associated frictional losses substantially increase the ECD of the drilling mud. These increases in ECD can often exceed the formation fracture pressure, at such depths. Furthermore, formation fracture pressures may be lower than seen onshore, and so conventional overbalanced conditions are undesirable due to the high risk of fracturing the formation.

Alternatively, formation pressures in these deep water well situations can be abnormally high, requiring heavier drilling mud weights to balance the well and prevent formation influx. This situation may also cause the circulating/drilling BHP to exceed formation fracture pressures.

These conditions can result in a narrow operating envelope for drilling—also referred to as a narrow drilling margin. It is defined as the small circulating/drilling BHP window resulting from upper and lower constraints from lower fracture pressures and higher pore pressures as the total depth of the well increases. This results in reduced flexibility in the circulating BHP during drilling and/or connections, posing significant challenges.

Therefore offshore, MPD operations are becoming more important for mitigating these risks and increasing overall safety on the drilling platform. A riser sealing solution for MPD allows enhanced pressure control over the riser and a safe diversion of formation influx (if it occurs) through a discharge/control manifold. It also allows lighter drilling mud weights to be used resulting in a decrease in hydrostatic pressure for drilling through lower fracture pressure zones, utilizing surface applied back pressure to impose the additional hydrostatic pressure on the wellbore if required.

SUMMARY OF THE INVENTION

According to a first aspect of the present invention there is provided a method of drilling a subterranean wellbore using a drill string including the steps of estimating or determining a reduced static density of a drilling fluid based on the equivalent circulating density of the drilling fluid in a section of the wellbore, providing a drilling fluid having substantially that reduced static density, introducing the drilling fluid having said reduced static density into the wellbore, and removing the drilling fluid from the wellbore via a return line.

In this specification, the term equivalent circulating density is used to describe the increase in bottom hole pressure generated when drilling fluid is circulated in a well bore, i.e. the difference between the bottom hole pressure during circulation of a given density of drilling fluid at a particular flow rate and the bottom hole pressure when this drilling fluid is stationary in the well bore.

The reduced static density of the drilling fluid may therefore be lower than the density of fluid required to control the well (i.e. to balance the formation pressure) when there is no circulation of the drilling fluid.

The drilling fluid may be introduced into the well bore via the drill string.

The method may comprise including using tubular risers to form a substantially annular space around the drill string such that the drilling fluid passes through the annular space to the return line.

The method may comprise including using a sealing device to seal the annular space so as to form a first section of tubular risers below the sealing device having a first annular space, and a second section of tubular risers above the sealing device having a second annular space, such that a substantially fluid tight seal is formed between the first and second annular spaces.

The method may also include passing the drilling fluid through the first annular space and removing the drilling fluid from the first annular space via the return line.

Fluid communication means may be provided between the first and second annular spaces, as may means for opening and closing the fluid communication means. The fluid communication means may comprise a flow passage or line and valve which is operable to permit or prevent flow of fluid along the flow passage.

Kill fluid may be stored in the first annular space.

The method may comprise opening the fluid communication means such that the kill fluid exerts pressure on the drilling fluid sufficient to retain the drilling fluid within the second annular space in the event of a kick, influx or blowout occurring in the wellbore.

The kill fluid may have a density greater than that of the drilling fluid having said reduced static density. The density of the kill fluid may be determined based on the equivalent circulating density of the drilling fluid at the wellbore.

The kill fluid may have a density substantially equal to that of the drilling fluid having the reduced static density. In this case the kill fluid may be pressurised so as to exert a pressure on the drilling fluid equal to a pressure generated by the equivalent circulating density at the wellbore, when the fluid communication means is opened.

The kill fluid may be pressurised, at least in part, using a riser booster pump.

The first part of the tubular risers may be provided with an outlet situated below the sealing device and connecting the outlet to the return line to return the drilling fluid to a managed pressure drilling system or riser gas handling system at a wellbore surface so as to form a first closed loop.

The method may include circulating the kill fluid in a second closed loop in the second section of the tubular risers.

The second section of the tubular risers may be provided with an outlet situated above the sealing device and the method may comprise connecting the outlet to a fluid line for returning the kill fluid to the managed pressure drilling system or riser gas handling system at a wellbore surface.

The method may comprise using a flow spool for connecting the outlets on the first and second sections of the tubular risers to the managed pressure drilling system or riser gas handling system.

The sealing device may be installed in a tubular riser near the top of the wellbore.

The method may include installing a blowout preventer near the top of the tubular risers and above the sealing device.

The method may comprise including using a second sealing device to seal the second annular space in the second section of tubular risers such that the second annular space has a top and a bottom portion that is sealed by the second sealing device and the sealing device respectively.

The method may comprise installing a blowout preventer adjacent and below the sealing device.

The sealing device may be positioned below a slip joint between tubular risers such that pressure exerted by the drilling fluid in the first annular space is not communicated to the slip joint.

A second aspect of the present invention provides a method of drilling a subterranean wellbore using a drill string, including the steps of estimating or determining a preferred static density of a drilling fluid for injection into the wellbore such that increases of the drilling fluid density caused by injection of the drilling fluid are within a control parameter associated with a formation pore pressure and/or formation fracture pressure of the wellbore, providing a drilling fluid having substantially that preferred static density, injecting the drilling fluid into the wellbore, and removing said drilling fluid from the wellbore via a return line.

The method of the second aspect may comprise one or more of the features of the first aspect.

A third aspect of the present invention provides apparatus for drilling a subterranean wellbore using a drill string, comprising a riser in which the drill string is at least partly contained, the riser defining a substantially annular space around the drill string, a sealing device disposed within the riser and forming first and second riser chambers, the first chamber being in fluid communication with a riser booster pump such that kill mud, stored in the first chamber, may be maintained at a pressure greater than that of the drilling fluid, in the second chamber.

The first and second chambers may be upper and lower chambers, respectively.

The apparatus of the third aspect may comprise one or more of the features of the first or second aspects.

According to a fourth aspect of the invention we provide a drilling system comprising a drill string, a riser in which the drill string is at least partly contained, the riser defining a substantially annular space around the drill string, a sealing device disposed within the riser and forming a first riser chamber around the drill string below the sealing device and a second riser chamber around the drill string above the sealing device, a source of drilling fluid operable to inject drilling fluid into the first riser chamber, a source of kill fluid operable to inject kill fluid into the second riser chamber, a flow line which extends between the first riser chamber and the second riser chamber, and a valve which is movable between an open position in which flow of fluid along the flow line is permitted, and a closed position in which flow of fluid along the flow line is substantially prevented.

The drilling system may be further provided with a riser booster pump which is in communication with the second riser chamber and which is operable to maintain kill mud stored in the second riser chamber at a pressure greater than that of the drilling fluid in the first chamber.

The kill fluid may have a density greater than that of the drilling fluid. Alternatively, the kill fluid may have a density similar or identical to the density of the drilling fluid.

The first riser chamber may be provided with an outlet situated below the sealing device and connecting the outlet to a return line to return the drilling fluid to a managed pressure drilling system or riser gas handling system at a wellbore surface.

The second riser chamber may be provided with an outlet situated above the sealing device and connecting second riser chamber to a fluid line for returning the kill fluid to the managed pressure drilling system or riser gas handling system at a wellbore surface.

The sealing device may be installed in a tubular riser near the top of a wellbore.

A blowout preventer may be installed near the top of the tubular risers and above the sealing device.

The drilling system may include a second sealing device which is mounted in the riser above the sealing device to seal the second riser chamber such that the second riser chamber has a top and a bottom portion that is sealed by the second sealing device and the sealing device respectively.

The drilling system may further comprise a blowout preventer installed adjacent and below the sealing device.

The sealing device may be positioned below a slip joint between tubular risers such that pressure exerted by the drilling fluid in the second annular space is not communicated to the slip joint.

closing a return valve in the return line to prevent flow of fluid along the return line before opening the valve in the flow line.

The table below compares the inventive method ('Zero ECD') to the current drilling methods in use, with their corresponding levels of safety for enhancing well and riser pressure control. The table illustrates that the inventive method yields a higher level of safety when compared to current drilling methods.

DRILLING METHODS - LEVEL OF SAFETY COMPARISON

| METHOD | LEVELS OF SAFETY FOR RISER PRESSURE CONTROL | COMMENT |
|---|---|---|
| Conventional | Static mud weight + ECD + safety margin<br>Rig SSBOP<br>Rig diverter system<br>3 LEVELS OF SAFETY | Existing technique<br>Higher density static mud weight for drilling<br>Riser pressure limited due to slip joint below diverter |
| MPD | Lighter static mud weight + ECD<br>Surface applied back pressure<br>Surface control handling system (including RCD/RDD/PCWD near surface)<br>Slow closing annular preventer below RCD/RDD/PCWD<br>Rig SSBOP<br>Rig diverter system<br>6 LEVELS OF SAFETY | Existing technique<br>Lesser density static mud weight for drilling<br>Seal point (RCD/PCWD) near surface<br>Riser integrity increased - slip joint can be isolated |
| Zero ECD | Lower static mud weight + ECD below RDD<br>Kill mud weight or pressurized lower static mud weight above the RDD sealing point<br>Surface applied back pressure<br>Surface control handling system (RGH and/or MPD)<br>Single or dual RDD configuration - subsea depth and/or subsea + top of riser<br>QCA and flow spool assembly<br>Rig SSBOP<br>Rig diverter system<br>8 LEVELS OF SAFETY | New technique<br>Lowest density static mud weight for drilling below seal point<br>Kill mud weight or pressurized lower static mud weight above seal point for contingency<br>Riser integrity increased - slip joint can be isolated<br>Deep and near surface sealing points<br>RDD deeper subsea<br>RDD top of riser<br>QCA near surface or subsea<br>Rapid seal off of riser with QCA |

According to a fifth aspect of the invention we provide a method of drilling a well bore using the drilling system according to the fourth aspect of the invention, the method comprising pumping drilling fluid into the first riser chamber via the drill string, while the valve in the flow line is in its closed position.

The method may further include pumping kill fluid into the second riser chamber whilst removing kill fluid from the second riser chamber from an outlet in the second riser chamber.

The method may further include the steps of operating a pump to maintain the kill fluid in the second riser chamber at a greater pressure than the drilling fluid in the first riser chamber.

The method may further include monitoring the fluid pressure at the bottom of the well bore, and if an influx, kick or blowout is detected, opening the valve in the flow line.

The method may further include the step of closing a blowout preventer installed near the top of the tubular risers and above the sealing device prior to opening the valve in the flow line.

The first riser chamber may be provided with an outlet situated below the sealing device and connected to a fluid return line, and the method further include the step of There is a need for a new approach in drilling techniques to meet the challenges of increasingly complex deep-water wells. Furthermore, there is a need for a new method to meet the requirements of drilling wells safely in deep-water environments which contain formations with lower than expected fracture pressures and/or narrow drilling margins. Furthermore, in more complex deep-water environments even the most current MPD practices are limited—thus presenting the need for the development of a new method to manage the increased risk and enhance overall well safety for drilling efficiently in such conditions.

The present invention provides a new drilling method and associated system design. The invention discusses the fundamentals, features, and contingencies of the method to illustrate its uniqueness and enhanced safety measures when compared to current drilling practices being used today. The inventive method can be applicable to offshore drilling operations that use the RDD technology or any modified pressure containment devices on the market that allow its deeper depth positioning in the riser system.

The QCA cannot be rotated/drilled through, and therefore it is required to have a pressure containment device that can be drilled through while maintaining pressure integrity below it—i.e. holding pressure on the volume contained from the top of the riser to directly above the subsea RDD.

Thus the pressurized lower static mud weight replaces the kill mud weight, and hence eliminates a dual mud weight system.

DESCRIPTION OF THE DRAWINGS

Specific and non-limiting embodiments of the invention will now be described, by way of example only, by reference to the following drawings of which.

DESCRIPTION OF THE INVENTION

Figure 1:
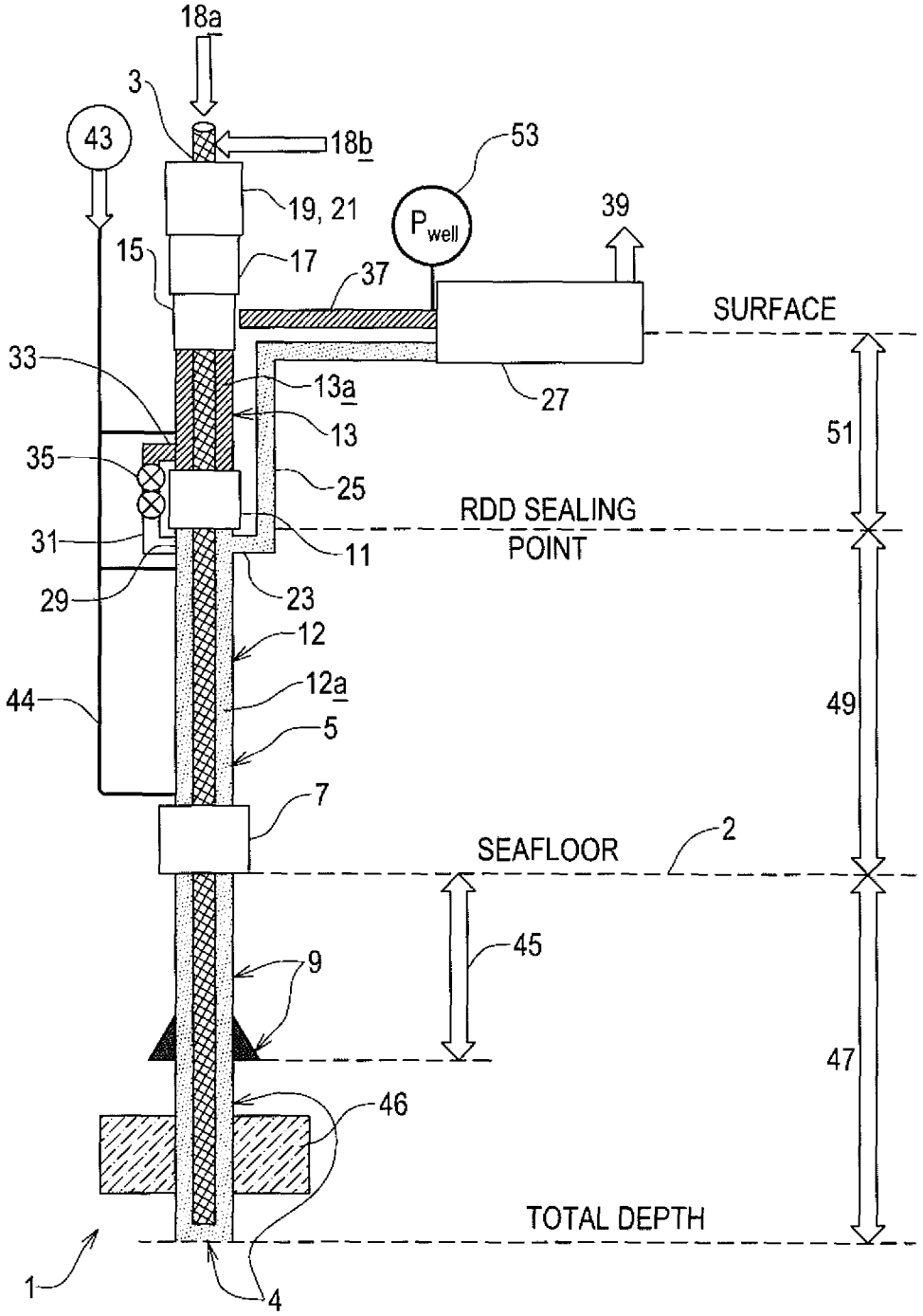
FIG. 1 is a schematic diagram of a drilling system for use with a method according to a first embodiment of the invention.

Referring to FIG. 1, a schematic illustration of an offshore drilling system 1 for drilling a wellbore below a seabed floor 2 is shown. The drilling system 1 includes a rig (not shown) situated at the surface of the sea that supports a drill string 3 which extends from the rig to the bottom of the wellbore. The drill string 3 may include sections of tubular joints connected end to end, with the outside diameters of the sections being determined by the geometry of the well bore being drilled and the effect the diameter will have on the fluid hydraulics in the wellbore. Mud pump 18*a* at the surface of the sea is used to pump drilling fluid/mud through the inside of the drill string 3 while drilling. There may be more than one mud pump 18*a*. Mud pump 18*a* may be connected to a manifold 18*b* which in turn connects to the drill string 3 while making drill string connections. Manifold 18*b* may be a continuous circulation manifold suitable for use in a method, referred to as continuous circulation, has been developed by the applicants to achieve constant circulation through a side bore in the section of drill string 3 at the surface before the top drive is disengaged for a connection. Further details of this method are hereby referenced in U.S. Pat. No. 2,158,356 for a description of this specific design of continuous circulation. Continuous circulation counteracts the negative effects on BHP associated with connections. The present invention may integrate the continuous circulation method and equipment into its procedure.

The pumping mechanism may be provided by a positive displacement pump. The rate of flow of the fluid into the drill string 3 is determined by the speed of the pumps.

The drill string 3 is contained in a riser 5 formed of a plurality of tubular sections that extend from the rig to a sub-sea blow out preventer (SSBOP) 7 that is situated on the seabed floor 2. The riser 5 provides an annular space above the wellbore surrounding the drill string 3. The riser 5 provides a continuous pathway for the drill string 3 and for the fluids emanating from the well bore 4 below the seabed. In effect, the riser 5 extends the wellbore from the seabed to the rig, and thus the total wellbore annulus includes the annular volume of the riser 5 as well.

Annular BOP elements of the SSBOP 7 are configured to seal around the drill string 3 thus closing the annulus between the drill string 3 and the riser 5 and stopping flow of fluid from the wellbore. The annular BOP elements typically include a large flexible rubber or elastomer packing unit configured to seal around a variety of drill string sizes when activated, but are designed not to be actuated during drill string rotation as this would rapidly wear out the sealing element. A pressurized hydraulic fluid and piston assembly are used to provide the necessary closing pressure of the sealing element. Typically these closing times are relatively slow due the large volume of power fluid that must be pressurized to operate the piston. These are well known in the art.

The drill string 3 also extends through a section of casing 9 that is situated below the SSBOP 7 and forms the last section of piping. The lowermost end of the drill string 3 extends past casing 9 into an open hole of drilled wellbore section 4 under the seabed floor 2.

The riser 5 includes a riser drilling device 11 (RDD) that is positioned apart from the SSBOP 7. The riser drilling device 11 provides a seal that closes the annular space around the drill string 3 whilst enabling the drill string 3 to rotate and reciprocate. The RDD 11 thus acts to form a first portion of the riser 12 below the RDD 11 and a second portion of the riser 13 above the RDD 11. The RDD 11 thus isolates the annular spaces of the first and second portions of the riser 12, 13 and forms a pressure seal. The RDD 11 also acts to divert any returning fluid within the annular spaces of the first and second portions 12, 13 enabling the fluid to be directed to any surface control equipment. In this embodiment the RDD 11 may have two adjacent sealing elements to provide increased protection against high pressures that may develop along the annular spaces of the riser 5. The RDD 11 permits the mud to circulate within a closed loop system as it forms a pressure seal around the drill string 3 in the riser 5. The RDD 11 may be replaced by any rotating pressure containment device that allows the drill string 3 to pass through the device while reciprocation, stripping or rotation is occurring but maintains pressure integrity around the drill string 3. The RDD 11 could be replaced by, for example, one of a rotating control head (RCD or RCH), pressure control while drilling (PCWD), or rotating blow out preventer (RBOP). All such tools are standard equipment that is known in the art.

A pressure containment device or riser drilling device suitable for use with the present invention is described in UK patent application GB1104885.7 and PCT/GB2012/050615 The riser drilling device described in these applications (the full contents of which are hereby incorporated herein, by way of reference) is made such that the riser drilling device can be installed deeper in the riser 5 at a specified subsea depth. This is because the engineering design permits the sealing assembly within the RDD housing to be retrieved and re-installed through the internal bore of the marine riser. This is unique and differs from current pressure containment devices on the market, most of which do not allow this—hence requiring the installation of these designs near the top of the riser. In addition to this, no modifications are required for the riser drilling device to withstand a higher magnitude of differential pressure (i.e. its ability to seal with forces across the sealing assembly from the difference in pressure above by a column of fluid in the second portion of the riser 13 and the first portion of the riser 12 below the RDD 11). This also differs from current designs in use, which require modifications to the sealing mechanism to accomplish this.

In short, the ability to set the RDD deeper in the riser configuration is an important component of the present invention. This will place the sealing point deeper, allowing its position to isolate the force of the hydrostatic pressure exerted by the stored kill mud weight in the riser section above the RDD sealing point from the wellbore below which contains a much lower static mud weight used for drilling.

The storage of kill mud weight directly above the sealing point provides immediate pressure contingency to the lower static mud weight in the drilling annulus if needed. The RDD may consist of a single or dual sealing element configuration but is not limited to this and may have a greater number of sealing elements. One to two RDD components may be required depending on the specified mud system utilized for the inventive method—a greater number of RDD components may also be used depending on the specific requirements of the system. Therefore, the present invention can integrate the RDD equipment of these two earlier applications into its procedure as it facilitates a safe and effective implementation of the method.

Adjacent an upper end of the second portion of the riser 13 is a riser flow spool system 15, quick closing annular (QCA) 17, slip joint 19 and diverter system 21 are provided. The function of these components is described below.

A design of QCA suitable for use with the present invention is described in GB1204310.5 and U.S. Ser. No. 13/443,332. The QCA 17 allows for rapid closure and isolation of the riser 5 in the event of unwanted gas in the riser 5 and/or RDD 11 integrity issues. When the QCA 17 is closed, the integrity of the riser 5 is increased as slip joint 19 is isolated from above permitting higher riser pressures to be applied to the riser 5 for removing any influx from the riser 5.

The top end of the first portion of the riser 12 has a first side outlet 23 that is connected to a first end of a section of flow line 25 and a second end of the section of flow line 25 is connected to a managed pressure device and/or riser gas handling device 27 that forms part of the surface control equipment. Flow line 25 provides for fluid communication between the annulus of the first portion of the riser 12 with the managed pressure device and/or gas handling device 27. The flow line 25 may be a large internal diameter pressure steel pipe. A steel pipe is preferable to a high pressure hose, as it will not have the movement, drifting, and resultant torque forces associated with hoses which results from ocean currents, rough seas, and rig movement. However, a section of high pressure hose may be used to connect the steel pipe near the top of the riser 5 to accommodate for any movement of the rig. The flow line 25 will run along the riser 5 in a common rail similar to a rig choke and kill lines which are known in the art.

A second side outlet 29 is provided at the top end of the first portion of the riser 12 which is connected to a first end of a flow line 31 and a second end of the flow line 31 is connected to a side outlet 33 situated at the bottom end of the second portion of the riser 13. The flow line 31 has a pair of hydraulically activated valves 35 for opening and closing the flow line 31. The valves 35 are configured such that the valves 35 can be operated remotely, and separately or together. The flow line 31 may be in the form of a high pressure arrangement having a large internal diameter. The valves 35 can therefore be used to bring the annular spaces of the first and second portions of the riser 12, 13 in and out of fluid communication with one another. The valves 35 are normally closed during drilling or connecting operations to prevent flow/communication between these two annular spaces.

The top end of the second portion of the riser 13 is connected to the riser flow spool system 15 such that the spool system can direct fluid within the annular space of the second portion of the riser 13 to the managed pressure device and/or riser gas handling system 27 via a section of high pressure flex hose 37. There is a degassing system 39 that receives mud from the managed pressure device and/or riser gas handling system 27 for removing any gas present in the mud before it is re-injected to the drill string 3 through mud pump 18.

A riser booster mud pump 43 is configured to inject fluid/mud into the riser 5 through side outlets at various points along the entire length of the riser 5. A modified riser booster line 44 is installed to allow the riser booster mud pump 43 to inject fluid into the riser at any point where it connects to the riser system 5. The riser booster flow line 44 runs externally along the entire length of the riser 5 within a common rail. The riser booster mud pump 43 is used to increase the flow rate of fluid inside the riser 5 during drilling operations, but can also be used to circulate a gas influx in the riser 5 and so can be used for both drilling and well control operations.

The vertical distances/depths between elements of the system will now be defined in order to illustrate (by way of example) a first embodiment of the invention. The SSBOP 7 is located on the seabed floor 2 and is connected to the top of the well bore section 4. The wellbore 4 extends below the SSBOP and the last casing 9 is set at 5,000 ft. This length has reference numeral 45 in FIG. 1. Along this length of the wellbore 4 there is a formation 46 of hydrocarbon fluid. The open hole/drilled section extends below reference numeral 45 to a further 2,000 ft below the casing 9 resulting in a total wellbore 4 depth of 7,000 ft below the SSBOP. This length, from the seabed floor to the bottom of the open hole section has reference numeral 47. The first portion of the riser 12, which extends from the SSBOP 7 to the RDD 11, has a length of 5000 ft. This length has reference numeral 49. The second portion of the riser 13, which extends from the RDD 11 to the QCA 17, is 1,500 ft. This length has reference numeral 51. Therefore, the total depth of the riser system is 6,500 ft (sum of reference numerals 49+51). The total well depth including the riser 5 is 13,500 ft (sum of reference numerals 47+49+51).

The method of operating the drilling system 1 will now be described. In normal operation mud pump **18*a* is configured to pump mud from a reservoir (not shown) into the drill string 3. The mud moves down through the drill string 3 and exits through one or more openings at the end of the drill string 3 adjacent the open hole/drilled section. The mud, under pressure from the mud pump 18*a* is then forced up along the annular space between the drill string 3 and the wellbore section 4. The mud travels further up, through the annular space in casing 9 until it moves past the SSBOP 7 and passes into the annular space of the first portion of the riser 12. The mud continues to travel along the first portion 12 to eventually pass through side outlet 23 at the top of the first portion of the riser 12 along flow line 25 into the managed pressure device and/or gas handling device 27. At the managed pressure device and/or gas handling device 27, a fluid pressure meter 53 measures the pressure of the returning mud. Based on the conditions along the riser 5 and wellbore, and the initial pressure of the mud as it entered the drill string 3, it is possible to determine whether the pressure at the fluid pressure meter 53 is higher or lower than an expected value. A higher pressure than expected may indicate that a fracture has occurred in the formation 46 and formation fluid, in the form of liquid or gas, has entered the wellbore thereby increasing pressure within the wellbore. Similarly, a lower pressure than expected may indicate that mud is being lost to the formation 46. Assuming that the pressure at the fluid pressure meter 53 is as expected, i.e. no fracture has occurred, the mud is then circulated through the degassing system 39 before returning to the reservoir and being re-circulated through the system. In this manner circulation of the mud during drilling continues through the first portion of the riser 12** only.

An aspect of the present invention is that, if it is predicted that the formation 46 about to be drilled has a lower than expected fracture pressure, or the pressure of the mud measured at the fluid pressure meter 53 indicates that a kick may soon occur, then a formation fracture may be avoided by taking account of the increase in density, i.e. the equivalent circulating density (ECD), of the mud from its static value compared to its circulating value.

It is possible to determine the ECD of a well by filling the well with mud of a static mud weight that balances the formation pressure when there is no circulation. This will exert a bottom hole pressure in the well for this static mud weight. Circulating that static mud weight will generate a higher bottom hole pressure (BHP) in the well. The difference between the two bottom hole pressures, static and circulating, is equal to the ECD of the well. This effective increase, caused in part by frictional losses along the length of the wellbore and riser, is not accounted for in existing managed pressure drilling operations. The applicants have found that in such situations where there is a narrow drilling margin to avoid a fracture whilst ensuring no influx occurs, this increase can be crucial in maintaining a safe BHP during drilling. The present invention provides for those situations, the use of a static mud density during normal drilling conditions that it is lower than is used in known (i.e. prior art) drilling systems and methods. This calculation is employed during drilling and it is ascertained whether the formation 46 is susceptible to fracture. The drilling system 1 is accordingly prepared for drilling as follows.

In order to illustrate the present invention (strictly by way of example only), an example using explicit numerical values will now be described.

A new (lower) static mud density is calculated based on the current static mud density of 10 ppg (pounds per gallon) and on the equivalent circulating density along the total well being 500 psi (pounds per square inch, expressed as the hydrostatic pressure) for this value of the static mud density over the entire vertical height of 13,500 ft (47+49+51) containing the drilling mud.

The hydrostatic pressure (in psi) of a column of mud at a certain depth is given by:

$$\text{Hydrostatic pressure} = \text{Mud density (ppg)} \times 0.052 \times \text{Depth (ft)}$$

This equation can be used to calculate the component of the static mud density (also known in the art as 'mud weight') caused by the equivalent circulating density effect:

Component of static mud $$\begin{aligned}\text{density due to } ECD &= ECD \text{ pressure}/(0.052 \times \text{depth of well})\\ &= 500/(0.052 \times 13{,}500)\\ &= 0.7 \text{ ppg.}\end{aligned}$$

The new (lower) static mud density is determined by subtracting this value (0.7 ppg) from the original static mud density (10 ppg) to give the new (lower) static mud weight density 12*a* as 9.3 ppg. This is the density of the mud weight that will be circulated through the drill string 3 to the wellbore 4 during drilling, before returning to the surface via casing 9, the first portion of the riser 12, and the flow line 25, and being re-circulated.

The next step of the method is to calculate the kill mud 13*a* density required for storing in the second portion of the riser 13. The length of the second portion of the riser is 1,500 ft. The kill mud 13*a* density must have sufficient density so as to deliver a hydrostatic pressure at the RDD 11 equal to the ECD value (500 psi) of the wellbore given that the length of the column of kill mud in the riser is 1,500 ft. On deployment of the kill mud 13*a*, i.e. when valves 35 are opened, the first and second portions of the riser 12, 13 are brought into fluid communication causing an associated pressure differential due to the difference in density between the lower static mud density 12*a* in the first portion of the riser 12 and the higher kill mud 13*a* density in the second portion of the riser 13. The kill mud 13*a* density must therefore be chosen such that it exerts a pressure that is the sum of the ECD of the well and balance the pressure differential of the lower static mud density 12*a*.

This is calculated as:

$$\begin{aligned}\text{Kill mud density} &= ECD/(\text{Length second portion of riser} \times 0.052) + \text{lower static mud density}\\ &= 500(1{,}500 \times 0.052) + 9.3 \text{ ppg}\\ &= 15.7 \text{ ppg.}\end{aligned}$$

This will be the kill mud 13*a* density that will be stored and contained in the second portion of the riser 13 above the RDD 11 as the valves 35 are closed, thus preventing the kill mud 13*a* from travelling through flow line 31 to the first portion of the riser 12. The kill mud 13*a* is held in storage whilst drilling takes place with the lower static mud weight 12*a*. The kill mud is ready for deployment to exert a pressure equivalent to the well ECD on the annular space of the first portion of the riser that extends below the RDD 11.

The drilling system 1 is then prepared with the two different mud densities as determined by this method. The existing mud within the first portion of the riser 12 and the wellbore 4 below the RDD 11 are displaced by the lower static mud density before drilling continues by pumping the lower static mud density 12*a* down the drill string 3 with the mud pump 18*a*. Circulating of the lower static mud density 12*a* continues so as to fill first portion of the riser 12, wellbore 4 and the casing 25 until it reaches the managed pressure device and/or gas handling device 27 thus completely displacing the old static mud density from the volume within the first portion of the riser 12 and the wellbore section 4 that extends below the SSBOP 7.

As will be explained below in greater detail, the first portion of the riser 12 contains the drilling mud that exits the drill string 3 and the mud is re-circulated through the first portion of the riser 12 via the surface during normal drilling procedure. The second portion of the riser 13 stores a quantity of kill mud 13*a*. This is not used during normal drilling conditions but is ready for deployment into the first portion of the riser 12 in the case of a kick situation. The kill mud 13*a* has a higher density such that it will exert a pressure that is equal to the equivalent circulating density of the well on the annulus of the first portion of the riser 12 below the RDD 11. The density of the mud to be used as a kill mud or for drilling can be changed by introducing additives into the mud as is known in the art. For example, a virgin or base fluid for a drilling system with no additives has a specific density/weight. By increasing the solids content in this fluid its density can be increased. Alternatively, by diluting or decreasing the solids content in a drilling fluid its density is decreased. Both of these conditions are altered through mixing processes which occur at the surface in a mud reservoir and storage system (not shown). This enables the operator to change the density of the mud to, for example, match the kill mud 13*a* density or lower static mud density 12*a*.

The old static mud weight in the second portion of the riser 13 is then displaced by the riser booster mud pump 43 pumping the calculated kill mud 13*a* through modified riser booster line 44 into the annulus of the second portion of the riser 13, whilst allowing the old static mud density to flow out of the second portion of the riser 13 through an outlet provided on the modified riser booster line 44 that is above the RDD 11. Once the entire second portion of the riser 13 contains the kill mud 13*a*, the kill mud 13*a* may be circulated continuously or intermittently through the riser booster mud pump 43 that is connected to side outlets in the second portion of the riser 13. The kill mud 13*a* is thus contained in a circulation loop that flows from the second portion of the riser 13 above the RDD 11, through an outlet of the diverter system 21. The casing 37 connects to a separate inlet on a manifold of the managed pressure device and/or riser gas handling system 27 at the surface. The kill mud 13*a* is then routed to a mud reservoir on the surface before being pumped back down by the riser booster mud pump 43 into the second portion of the riser 13. The kill mud 13*a* circulation loop is thus independent of the drilling circulation loop. The kill mud 13*a* circulation loop helps to maintain consistent mud properties and prevents solids present in the kill mud 13*a* from settling on a top portion of the sealing mechanism of the RDD 11.

Normal drilling using the drilling system 1 as prepared above then resumes. Drilling continues with the lower static mud density being pumped down the drill string 3 and circulated back to the managed pressure drilling device and/or riser gas handling system 11, and then re-circulated from the surface as previously described.

As drilling progresses, the formation 46 may be penetrated. A known well control method for managed pressure drilling operations could be employed, for example, application or non-application of a surface applied back pressure through action of a choke at the managed pressure drilling device 27. Application of the back pressure will depend on the particular conditions required to maintain a constant BHP. When a new section of drillpipe is required, the continuous circulation manifold and mud pump 18 may be implemented in combination with surface applied back pressure at the managed pressure drilling device 27 to maintain a constant BHP, as described (for example) in GB2469119.

Through constant monitoring of the mud pressure, for example at the fluid pressure meter 53 at the surface, an unexpected formation influx may be detected as having entered the riser 5. The method of the present invention then involves turning off or closing the following components of the drilling system 1 to protect the system against the spike in pressure associated with the influx. The riser booster mud pump 43 is turned off and the QCA 17 closed so as to seal the top of the riser 5. Similarly the casing 37 that connects the second portion of the riser 13 to the riser flow spool system 15 is closed. The mud pump 18*a* is turned off and the manifold of the managed pressure device 27 is closed. This traps the current surface applied back pressure to the mud within the first portion of the riser 12. In this example, the back pressure is 100 psi. The closing sequence of the SSBOP 7 is implemented and this may take up to 2 minutes. A more rapid-closing SSBOP is disclosed in GB1204310.5 and U.S. Ser. No. 13/443,332. During this period, the valves 35 are opened to allow kill mud 13*a* to flow through the flow line 31 such that the kill mud 13*a* in the second portion of the riser 13 above the RDD immediately applies pressure to the lower static mud density 12*a* in the first portion of the riser 12 below the RDD 11. This pressure is equivalent to the ECD value of the well (500 psi) and reduces any loss caused by the lower static mud density 12*a* not having its increased value during circulation due to the ECD effect when circulation was stopped. The pressure is exerted instantaneously and increases the BHP so as to prevent further influx from the formation 46.

There are two forces acting at the point where the RDD 11 is positioned. These are the hydrostatic pressure of the kill mud weight 13*a* acting downwards on the RDD 11, and the applied back pressure and the hydrostatic pressure of the lower static mud density 12*a* in the flow line 25 that lies above the side outlet 23 of the first portion of the riser 12 which both act upwards on the RDD 11. In other words, the lower static mud density 13*a* within the first portion of the riser 12 is in contact with the bottom surface of the RDD 11 and since the lower static mud density 13*a* is at a certain pressure, caused by the applied back pressure and weight of mud above the side outlet 23, it will exert a corresponding force on the RDD 11. Thus, the net pressure applied to the wellbore will be the difference (i.e. the differential) of these two forces acting at the RDD 11:

1. Net pressure applied at $RDD =$

Hydrostatic pressure of kill mud at $RDD -$

Pressure exerted by mud in the first portion of the riser 12.

Pressure exerted by mud in the first portion of the riser 12 =

Hydrostatic pressure of lower static mud weight in flow line 25 + applied back pressure =

$$(9.3\ \text{ppg} \times 0.052 \times 1{,}500\ \text{ft}) + 100\ \text{psi} = 825\ \text{psi}$$

This gives the net pressure applied at RDD as:

$$\text{Net pressure applied at } RDD = (15.7\ \text{ppg} \times 0.052 \times 1500) - 825\ \text{psi}$$

$$= 400\ \text{psi}.$$

It can be seen that the kill mud 13*a* thus exerts a hydrostatic pressure that brings the original ECD pressure to the well. The net effect of 400 psi on the well thus returns conditions in the well to a balanced or slightly overbalanced state where no additional influx will occur from the formation 46. The 400 psi value will be observed at the surface on the fluid pressure meter 53 and any other pressure reading device at the managed pressure drilling device and/or on the riser 5. It will be appreciated that the manifold of the managed pressure drilling device 27 must be closed to ensure the kill mud, which is heavier than the lower static mud weight 12*a*, does not create a u-tube effect. This will result in a migration of the kill mud 13*a* in the second portion of the riser 13 towards the first portion of the riser 12 as it has a higher density and exerts a net force downwards. As a result, there will be an associated decrease in the height of the kill mud 13*a* above RDD 11 with a corresponding loss of exerted pressure on the lower static mud density within the first portion of the riser 12. There will also be a minor mixing of the two mud weights due to the difference in their densities, even with the well being shut in.

Once the SSBOP 7 has closed the riser 5 is effectively isolated from the wellbore 4 below it. Subsequently, the valves 35 are closed so as to close piping 31 and well control procedures are used to remove the gas introduced to the mud in the first portion of the riser 12 due to the influx. This involves circulating the mud with the riser booster mud pump 43 through a bottom inlet on the first portion of the riser 12 upwards through the flow line 25 to managed pressure device and/or riser gas handling system 27 and degassing system 39 at the surface. The QCA 17 will remain closed and acts as a contingent barrier to the RDD 11 so as to seal the riser 5 during the well control procedures. The QCA 17 provides an additional safety measure to the present invention as it can rapidly seal the riser 5 and thereby isolate the annular space within the riser 5. Thus any influx of gas from a formation can be contained and controlled. The QCA 17 also acts as a contingency seal should the RDD 11 seal fail for any reason. It will be understood, however, that the present invention does not require the use of the QCA 17.

The RDD 11, by providing a sealing point, permits the storage of the kill mud 13*a* and circulation of the drilling mud of the lower static mud density 12*a*. Hence, it permits the drilling system 1 to operate with two different mud weights, where the kill mud can be deployed as a contingency should an influx occur. This contingency allows the static mud weight/density taught by the prior art to be safely reduced in this inventive method by a value of the total equivalent circulating density (ECD) existing over the entire wellbore geometry. This is important in wells where the ECD of the well can increase the BHP above the formation fracture pressure during circulation/drilling periods in the wellbore. As water depth increases this risk increases as the additional ECD and hydrostatic pressure exerted on the formation from the extended length of riser from the seabed to the surface above are both correspondingly higher. The ECD during circulating/drilling can also lead to the BHP being slightly or substantially higher than in static conditions (i.e. not drilling/circulating). The significance of this effect is not recognised in the prior art, but is addressed in and by the present invention.

Importantly, the present invention permits the use of a lower static mud density which has been calculated by offsetting its original static mud density by an amount equal to the ECD value existing over the entire wellbore length. The lower static mud density then has a net zero ECD effect in the wellbore during drilling/connecting. One advantage of this is that a lower mud weight density can be used, saving the effort and time required to mix a higher density mud and saving the cost of adding materials to increase the density of the mud. Similarly, cost and operational power savings are made during drilling/circulating the lower mud density in comparison to a heavier mud weight, so wear on pumps (for example) is reduced. The higher density kill mud held in storage provides a safety contingency resulting in a safer and more efficient drilling operation in deep water environments which have narrow drilling margins and/or subnormal formation fracture pressures. Thus, unlike prior art systems and operations, the present invention decreases the risk of the BHP exceeding the fracture pressure. However, ECD is not eliminated by this method as it will always exist during circulation/drilling in any drilling operation, as friction losses are always present in the wellbore. An aspect of the inventive method lies in changing the density of the drilling mud so as to offset this ECD value. Therefore, there is still an ECD present during circulating/drilling with the lower static mud weight, but the overall effects on the BHP are decreased by the original ECD value.

The inventive method uses the kill mud weight in combination with applied surface back pressure from the managed pressure device and/or the riser gas handling system 27 to provide an immediate pressure response to the wellbore so as to control any influx such as gas entering the riser 5 during drilling/connecting. Using the applied surface back pressure prevents uncontrolled gas migration in the riser 5 and any further influx from the formation 46 while the SSBOP 7 undergoes its closure sequence.

A variation of the first embodiments of the invention does not have a QCA and the diverter system and slip joint are exposed to the pressure in the riser.

As drilling progresses further sections of pipe have to be connected to the existing drill string 3 in order to drill deeper. Conventionally, this involves disengaging the top drive that drives the drill string, thus shutting down all fluid circulation completely to enable connection to the existing drill string. During such connection operations, the BHP decreases by a large amount which can lead to events such as influx, and cuttings drop out. Furthermore, for deeper wells the large variances in the drilling fluid properties due to high bottom hole temperatures, which are not an issue during circulating/drilling, become an issue when static conditions exist during a connection or other non-circulation event.

The applicants have developed several devices that may be used in conjunction with the present invention. A QCA device with that is suitable is described in GB1204310.5 and U.S. Ser. No. 13/443,332. However, a conventional annular preventer device may also be used.

The QCA device is similar in principle to conventional annular preventers, described herein, but unique in its operation as it requires a smaller volume of power fluid to drive its piston assembly which opens/closes the sealing element.

This results in rapid closing times, allowing the wellbore/riser to be sealed off and isolated quickly—2 seconds or less when tubulars/drill pipe are across the internal bore, and 5 seconds or less to seal off an open bore (i.e. no tubulars across its internal bore). A standard drilling annular preventer element will take up to 30 seconds to close due to the large volume of power fluid that must be pressurized to drive the piston assembly, and depending on the efficiency and speed of the rig crew the closing procedure could take up to 2 minutes. In the absence of a QCA (as covered by the applicants' co-pending applications), this is an extensive period of time which could allow the formation to continuously influx until the SSBOP was closed, increasing the risks involved in managing and controlling larger influx volumes when they reach the surface.

Therefore, the inclusion of a QCA in the riser configuration will enhance both riser integrity and well control, as its position isolates the pressure limiting component—the rig's slip joint (located at the riser top). The return flow stream flows to the surface via a flow spool and flow line located directly below it. Depending on its position, it will also isolate the RDD from the well below to change the sealing element assembly.

The QCA thus permits pressure to be applied to the wellbore below the QCA sealing point which may be required to control gas in the riser, while eliminating the pressure limitations of the slip joint above. Hence, this makes the QCA an optimal safety measure in any marine riser configuration and is an important (but not necessarily essential) apparatus for the present invention. The QCA, its structural design and operating philosophy are described in detail in the applicants' co-pending UK and US patent applications, set out above. For the avoidance of doubt, certain configurations of the present invention may not require the QCA, depending on the RDD positioning in the riser system.

The Riser Gas Handling (RGH) system is another riser gas handling and pressure control system designed by the applicants. Its main components are a flow spool, a Quick Closing Annular (QCA) as described herein, a gas handling manifold utilizing rapid response choke valves referred to as pressure control valves (PCV's), and a Mud Gas Separator (MGS) for degassing the drilling fluid. Compared to a conventional MPD surface system, the RGH system is unique in that it allows higher capacity gas and liquid surge rates resulting from gas influx expansion in the riser to be safely controlled at surface with the control manifold and MGS. All are well known in the art, and thus the complete RGH system provides the ability to seal off the riser top and safely remove gas from the riser system and degas the drilling fluid for re-injection into the well. The RGH is not an MPD system, and is only used to remove influx when it is present in the riser—thus it runs in parallel with an existing MPD surface system. Its high gas and liquid flow rate capacity enhances the level of well control and increases the integrity of the marine riser.

The RGH, its design and operating philosophy are described in detail in GB1206405.1.

Although the RGH is optional, it would increase the safety level of the inventive method. At a minimum, the inventive method requires an MPD surface control system for its effective and safe operation. Thus, the inventive method will integrate an MPD surface control system described herein and/or a Riser Gas Handling system for controlling and managing the return flow from the riser and wellbore.

Figure 2:
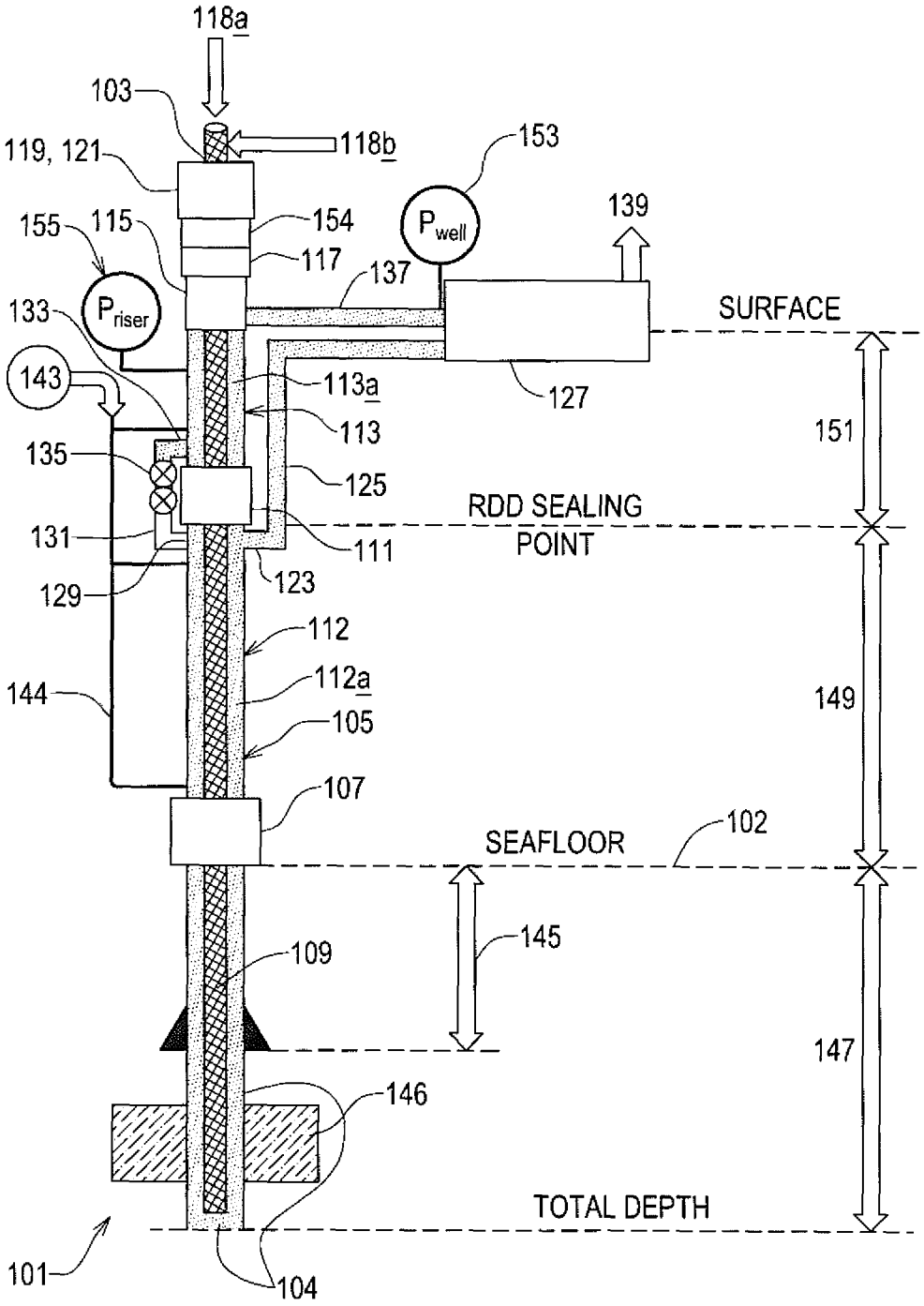
FIG. 2 is a schematic diagram of a drilling system for use with a method according to a second embodiment of the invention.

Referring next to FIG. 2, components of the drilling system 101 that are the same as components of the drilling system of the first embodiment of the invention have the same reference numeral with the addition of 100. This drilling system 101 has been configured to be used as a single mud weight system as opposed to the dual mud weight system 1 of the first embodiment. The drilling system 101 includes a further riser drilling device (RDD) 154 that is located between diverter system 121 and riser flow spool system 115. QCA 117 is located underneath RDD 154 but may be located anywhere along the riser 105, including below the RDD 111 or may not be required at all.

RDD 154 maintains a seal so that the fluid in the riser 105 above the RDD 154 does not communicate with the fluid contained in the riser 105 below the RDD 154. In this embodiment, RDD 154 has a single sealing element but may be provided with more than one sealing element and the QCA 117 forms a contingency seal should RDD 154 fail for any reason. RDD 111 serves the same function as the RDD 11 of the first embodiment in that it maintains the isolation of the annular spaces of the first and second portions of the riser 112, 113 and prevents the mud contained in the second portion of the riser above the RDD 111 from exerting a pressure on the mud contained in the first portion of the riser 112. In this example, RDD 111 includes a dual sealing element as a contingency should one element fail. The elements may work independently of one another, i.e. both elements may provide the seal on the drill string 103. Alternatively, the top sealing element may provide the pressure seal and isolation required during drilling, whilst the bottom sealing element is provided as a contingency in case the top sealing element leaks or fails.

Operation of the drilling system 101 will now be described. RDD 154 is normally closed during drilling operations. The seal provided by RDD 154 permits pressurisation of the second portion of the riser 113 that contains the kill mud 113*a*. However, instead of the kill mud 113*a* having a higher/different density to the drilling mud of the lower static mud weight 112*a* as in the first embodiment, this embodiment stores the kill mud 113*a* in the form of the lower static mud density 112*a* used for drilling but is held at a pressure equal to the well ECD.

In a situation where a formation is sensitive to a fracture, the lower static mud density 112*a* is calculated in the same manner as the first embodiment and therefore has the density 9.3 ppg. However, a single mud weight is used in the second embodiment and so the kill mud 113*a* has the same density as the lower static mud density 112*a*. The difference is that the second portion of the riser 113 is pressurized by riser booster mud pump 143 injecting the lower static mud density into the second portion of the riser 113. As the top of the second portion of the riser 113 is sealed by RDD 154 and the bottom of the second portion of the riser 113 is sealed by RDD 111, the pressure of the kill mud 113*a* will increase. A fluid pressure meter 155 measures the pressure of the mud 113*a* in the second portion of the riser 113. Pressurisation will continue until the pressure reading on the fluid pressure meter 155 reaches the ECD pressure, which in this example is 500 psi. The kill mud 113*a* is then stored at a pressure of 500 psi ready for deployment as required. With the exception of this step, the drilling system 101 is prepared according to the same method as that described in connection with the first embodiment.

The steps used to deal with an influx using the drilling system 101 which uses a single mud density, are identical to those of the drilling system 1 which uses dual mud weights. Therefore, when the valves 135 are opened the same net pressure is exerted on the mud contained in the first portion of the riser 112. Assuming the same initial conditions as those given in the example for the first embodiment, the calculation is as follows.

Since the mud densities of the kill mud and the drilling mud are identical, there is no pressure differential from the column of mud in flow line 125. The pressure exerted by the mud in the first portion of the riser 112 is thus equal to the back pressure that was applied by the managed pressure device 127, which is 100 psi.

The net pressure applied at the RDD 111 is given by:

$$\begin{aligned}\text{Pressure at } RDD\ 111 &= \text{Pressure of mud in second portion of the riser } 113 - \text{Pressure of mud in first portion of the riser } 112\\ &= ECD - \text{Back pressure}\\ &= 500 - 100\\ &= 400 \text{ psi.}\end{aligned}$$

An advantage of the single mud density drilling system is that there is no contamination of the first portion of the riser 112 with a different mud weight once deployment of the kill mud has occurred. Contamination between different mud weights would require stopping the drilling operation until the mud in the first portion of the riser 112 is returned to a homogeneous state, i.e. a single fluid having the lower static mud weight. Furthermore, contamination will also be avoided if RDD 111 fails. As part of the method of this embodiment, it is still necessary to close the manifold of the managed pressure device 127. This is because, although there will not be a u-tube effect because the mud weights are the same, the manifold has a pressure control valve that will attempt to bleed off the pressure increase of 400 psi caused by deployment of the kill mud as this valve is normally programmed to maintain a constant surface pressure. Thus this method shuts in the pressure existing within the system before the kill mud is deployed.

The use of a riser booster mud pump and riser booster flow line 144 is known in the art for connecting to the bottom of a riser and is used to boost circulation of mud over the whole length of the riser, i.e. from the bottom of the riser through to the surface. However, using the riser booster mud pump and riser booster flow line so as to pressurise a section of a riser to create a column of pressurised kill mud for deployment is a new and important aspect of the present invention.

Figure 3:
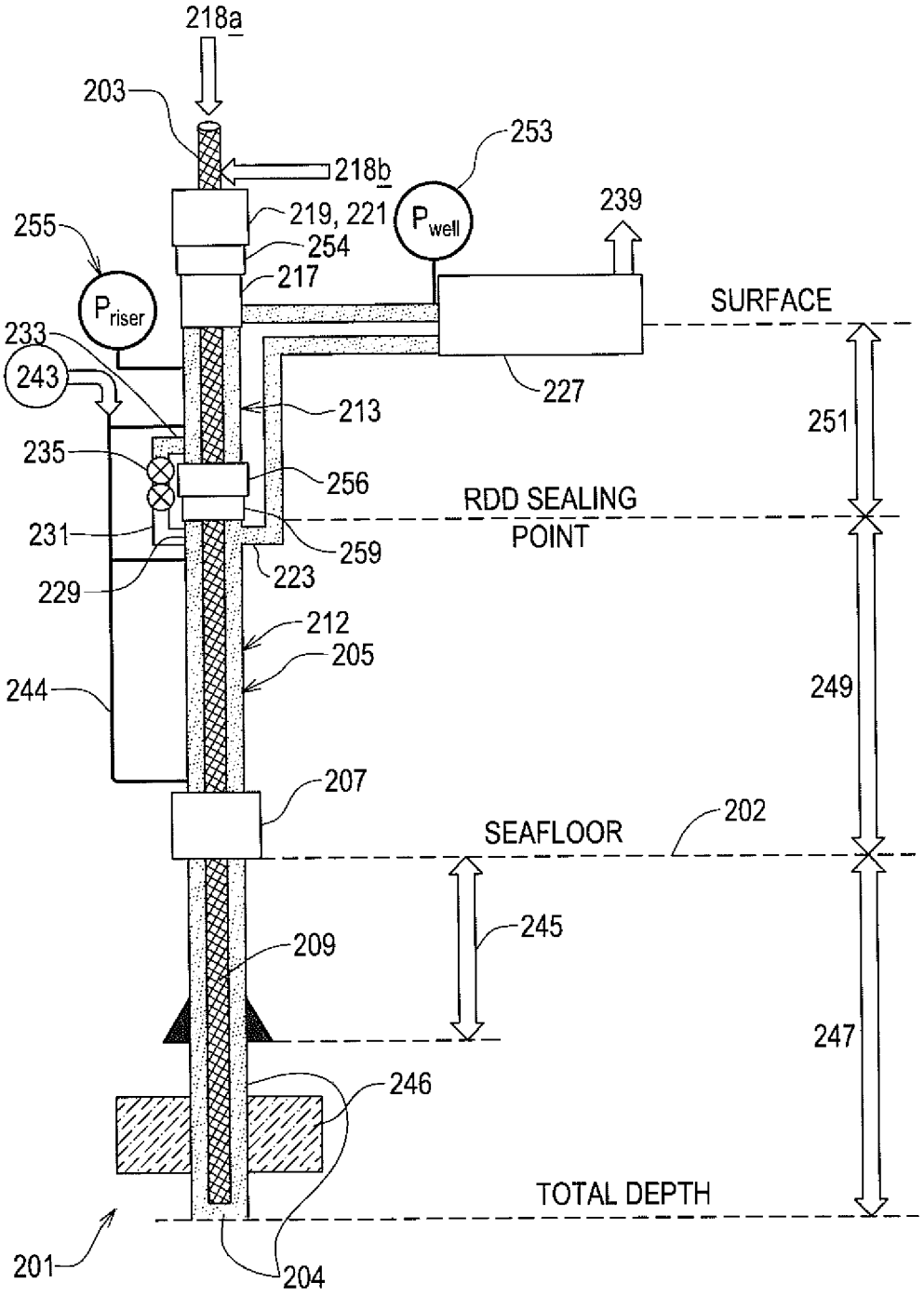
FIG. 3 is a schematic diagram of a drilling system for use with a method according to a third embodiment of the invention.

Referring to FIG. 3, components of the drilling system 201 that are the same as components of the drilling system of the second embodiment of the invention have the same reference numeral with the addition of a further 100 (meaning that the numerals start with a '2'). The difference between drilling system 201 and drilling system 101 is the location of the QCA (or similar closing) device and design of RDD 256 that isolates the annular spaces of the first and second portions of the riser 212, 213. In this embodiment, RDD 256 has a single sealing element, as opposed to RDD 11 and RDD 111 of the first and second embodiments which had two sealing elements. QCA 259 is positioned directly underneath RDD 256 in the first portion of the riser 212 that extends below the RDD 256. The drilling system 201 is still a single mud density system and is operated identically (in the event of an influx) to the second embodiment of the invention. The QCA 259 is thus a contingency device that can seal the riser 5 quickly should the sealing element of RDD 256 fail or an influx occur in the riser 5. However, as the QCA 259 is not designed to withstand the forces created during drill string rotation it is not to be used for drilling.

All calculations are performed in the same manner as that for the second embodiment and the kill mud deployment procedure is also identical.

The second and third embodiments of the invention have other advantages over and above the use of a single mud weight of a lower static mud density, as drilling systems using a single mud density are less complex to operate in comparison to a dual-mud weight system.

Embodiments of the inventive method can be performed by modification of existing off-shore riser configurations to include a riser drilling device. Optionally, a quick closing annular preventer (QCA) and riser flow spool system may also be added to existing off-shore riser configurations. It will be appreciated that according to the embodiment employed, the QCA may be installed at, but not limited to, a position either above or below the subsea RDD that seals the first and second portions of the riser, or the QCA may not be used at all. If the QCA is not used, then the subsea RDD must have two sealing elements.

The invention thus allows control of the BHP using either a single or dual mud weight configuration in any riser, with the choice of configuration dependent on the RDD configuration employed within the riser while drilling/connecting. Embodiments of the method of the invention can be used with known mud based systems for drilling/connecting operations.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of drilling a subterranean wellbore using a drill string, including the steps of:

estimating or determining a reduced static density of a drilling fluid based on the equivalent circulating density of the drilling fluid in a section of the wellbore;

providing a drilling fluid having substantially that reduced static density;

introducing the drilling fluid having said reduced static density into the wellbore;

using a tubular riser to form a substantially annular space around the drill string;

using a sealing device to seal the annular space so as to form a first section of the tubular riser below the sealing device having a first annular space, and a second section of the tubular riser above the sealing device having a second annular space, such that a substantially fluid tight seal is formed between the first and second annular spaces, wherein a top end of the first section of the tubular riser has a first side outlet which is connected to a first end of a return line, a second end of the return line being connected to surface control equipment comprising at least one of a managed pressure device and a riser gas handling device, and a second side outlet which is connected to a first end of a flow line and a second end of which is connected to a side outlet situated at a bottom end of the second section of the tubular riser, there being a valve provided for opening and closing the flow line; and removing the drilling fluid from the wellbore via the return line.

2. The method according to claim 1, wherein the drilling fluid passes through the annular space to the return line.

3. The method according to claim 1, further including the step of passing the drilling fluid through the first annular space and removing the drilling fluid from the first annular space via the return line.

4. The method according to claim 1, further including the step of storing kill fluid in the second annular space, and opening the fluid communication means in the event of a kick, influx or blowout occurring in the wellbore.

5. The method according to claim 4, wherein the kill fluid has a density greater than that of the drilling fluid having said reduced static density.

6. The method according to claim 5, wherein the density of the kill fluid is determined based on the equivalent circulating density used in determining the reduced static density of the drilling fluid.

7. The method according to claim 4, wherein the kill fluid has a density substantially equal to that of drilling fluid having the reduced static density and wherein the kill fluid is pressurized so as to exert a pressure on the drilling fluid equal to a pressure generated by the equivalent circulating density at the wellbore, when the fluid communication means is opened.

8. The method according to claim 1, wherein the first section of the tubular riser is provided with the first side outlet situated below the sealing device and connecting the first side outlet to the return line to return the drilling fluid to the at least one of a managed pressure drilling system and a riser gas handling system at a wellbore surface so as to form a first closed loop.

9. The method according to claim 8, further including the step of circulating the kill fluid in a second closed loop in the second section of the tubular riser.

10. The method according to claim 9, wherein the second section of the tubular riser is provided with an outlet situated above the sealing device and connecting the outlet to a fluid line for returning the kill fluid to the at least one of a managed pressure drilling system and a riser gas handling system at a wellbore surface.

11. The method according to claim 2, further including the step of using a second sealing device to seal the second annular space in the second section of the tubular riser such that the second annular space has a top and a bottom portion that is sealed by the second sealing device and the sealing device respectively.

12. A method of drilling a subterranean wellbore using a drill string, including the steps of:

estimating or determining a preferred static density of a drilling fluid for injection into the wellbore such that increases of the drilling fluid density caused by injection of the drilling fluid are within a control parameter associated with at least one of a formation pore pressure and a formation fracture pressure of the wellbore;

providing a drilling fluid having substantially that preferred static density;

injecting the drilling fluid into the wellbore;

using a tubular riser to form a substantially annular space around the drill string;

using a sealing device to seal the annular space so as to form a first section of the tubular riser below the sealing device having a first annular space, and a second section of the tubular riser above the sealing device having a second annular space, such that a substantially fluid tight seal is formed between the first and second annular spaces, wherein a top end of the first section of the tubular riser has a first side outlet which is connected to a first end of a return line, a second end of the return line being connected to surface control equipment comprising at least one of a managed pressure device and a riser gas handling device, and a second side outlet which is connected to a first end of a flow line and a second end of which is connected to a side outlet situated at a bottom end of the second section of the tubular riser, there being a valve provided for opening and closing the flow line; and removing said drilling fluid from the wellbore via the return line.

13. A method of drilling a well bore using a drilling system comprising a drill string, a riser in which the drill string is at least partly contained, the riser defining a substantially annular space around the drill string, a sealing device disposed within the riser and forming a first riser chamber around the drill string below the sealing device and a second riser chamber around the drill string above the sealing device, a source of drilling fluid operable to inject drilling fluid into the first riser chamber, a source of kill fluid operable to inject kill fluid into the second riser chamber, a flow line which extends between the first riser chamber and the second riser chamber, and a valve which is movable between an open position in which flow of fluid along the flow line is permitted, and a closed position in which flow of fluid along the flow line is substantially prevented, the method comprising the steps of pumping drilling fluid into the first riser chamber via the drill string, while the valve in the flow line is in its closed position; and operating a pump to maintain the kill fluid in the second riser chamber at a greater pressure than the drilling fluid in the first riser chamber, wherein, the first riser chamber is provided with an outlet situated below the sealing device and connected to a fluid return line.

14. The method of drilling a well bore according to claim 13, further including the step of pumping kill fluid into the second riser chamber whilst removing kill fluid from the second riser chamber from an outlet in the second riser chamber.

15. The method of drilling a well bore according to claim 14, further including the step of monitoring the fluid pressure at the bottom of the well bore, and if an influx, kick or blowout is detected, opening the valve in the flow line.

16. The method of drilling a well bore according to claim 15, further including the step of closing a blowout preventer installed near the top of the riser and above the sealing device prior to opening the valve in the flow line.

17. The method of drilling a well bore according to claim 15, wherein the first riser chamber is provided with an outlet situated below the sealing device and connected to a fluid return line, and the method further includes the step of closing a return valve in the return line to prevent flow of fluid along the return line before opening the valve in the flow line.

* * * * *